US010023987B2

(12) United States Patent
Kim et al.

(10) Patent No.: US 10,023,987 B2
(45) Date of Patent: Jul. 17, 2018

(54) LAUNDRY TREATMENT APPARATUS

(71) Applicant: LG ELECTRONICS INC., Seoul (KR)

(72) Inventors: Keunjoo Kim, Seoul (KR); Seungchul Park, Seoul (KR); Jongryong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 346 days.

(21) Appl. No.: 14/177,943

(22) Filed: Feb. 11, 2014

(65) Prior Publication Data

US 2014/0223969 A1 Aug. 14, 2014

(30) Foreign Application Priority Data

Feb. 13, 2013 (KR) ..... 10-2013-0015375

(51) Int. Cl.

| | |
|---|---|
| ***D06F 37/22*** | (2006.01) |
| *D06F 37/20* | (2006.01) |
| *D06F 37/06* | (2006.01) |
| *D06F 39/08* | (2006.01) |
| *D06F 33/02* | (2006.01) |
| *D06F 37/04* | (2006.01) |

(52) U.S. Cl.

CPC ..... *D06F 37/225* (2013.01); *D06F 33/02* (2013.01); *D06F 37/04* (2013.01); *D06F 37/06* (2013.01); *D06F 37/203* (2013.01); *D06F 39/088* (2013.01); *D06F 2202/12* (2013.01); *D06F 2204/086* (2013.01); *D06F 2222/00* (2013.01)

(58) Field of Classification Search

CPC ..... D06F 37/225

See application file for complete search history.

(56) References Cited

U.S. PATENT DOCUMENTS

| | | | | |
|---|---|---|---|---|
| RE24,104 | E | 12/1955 | Robbins | |
| RE24,140 | E | 4/1956 | Kahn | |
| 2,791,917 | A | 5/1957 | Kahn et al. | |
| 3,080,059 | A | 3/1963 | Scott et al. | |
| 3,135,688 | A | 6/1964 | Compans et al. | |
| 3,190,447 | A | 6/1965 | Scott et al. | |
| 5,280,660 | A | 1/1994 | Pellerin et al. | |
| 2006/0254321 | A1* | 11/2006 | Lim | D06F 37/225 68/12.01 |
| 2011/0037423 | A1* | 2/2011 | Koda | H02P 6/182 318/400.37 |
| 2012/0144879 | A1 | 6/2012 | Verma et al. | |

(Continued)

FOREIGN PATENT DOCUMENTS

| | | | |
|---|---|---|---|
| CH | 672803 | A5 | 12/1989 |
| CN | 1304468 | A | 7/2001 |

(Continued)

*Primary Examiner* — Jason Ko

(74) *Attorney, Agent, or Firm* — Dentons US LLP

(57) ABSTRACT

A laundry treatment apparatus including a rotatable drum in which laundry is stored, at least three balancers mounted to the drum so as to be spaced apart from one another by the same angle around a rotation center of the drum. Liquid is introduced into and discharged from the balancers via a feeder supplying the liquid and a flow path structure mounted to the drum to guide liquid supplied from the feeder to the balancer located in a direction for removal of unbalance of the drum.

8 Claims, 13 Drawing Sheets

(56) References Cited

U.S. PATENT DOCUMENTS

| | | | |
|---|---|---|---|
| 2012/0144881 | A1 | 6/2012 | Farid et al. |
| 2013/0031939 | A1 | 2/2013 | Hasanreisoglu et al. |

FOREIGN PATENT DOCUMENTS

| | | | |
|---|---|---|---|
| EP | 0856604 | A2 | 5/1998 |
| EP | 1143059 | A2 | 10/2001 |
| EP | 1655404 | A1 | 5/2006 |
| EP | 1693500 | A2 | 8/2006 |
| EP | 2025797 | A1 | 2/2009 |
| GB | 920791 | | 3/1963 |
| JP | 10-146491 | A | 6/1998 |
| JP | 2002-136792 | A | 5/2002 |
| JP | 2003-159491 | A | 6/2003 |
| WO | 99/53130 | A2 | 10/1999 |
| WO | 01-029304 | A2 | 4/2001 |
| WO | 20071077128 | A1 | 7/2007 |
| WO | 2011-144558 | A1 | 11/2011 |
| WO | 2011-144559 | A1 | 11/2011 |

* cited by examiner (a)

(b)

( a )

( b )

(a)

(b)

LAUNDRY TREATMENT APPARATUS

Pursuant to 35 U.S.C. § 119(a), this application claims the benefit of Korean Patent Application No. 10-2013-0015375, filed on Feb. 13, 2013, which is hereby incorporated by reference as if fully set forth herein.

BACKGROUND

Field

The present disclosure relates to a laundry treatment apparatus.

Discussion of the Related Art

A conventional laundry treatment apparatus includes a cabinet defining an external appearance of the apparatus, a tub installed within the cabinet, a drum rotatably installed within the tub such that laundry is washed in the drum, and a motor. The motor includes a rotating shaft which penetrates the tub and is coupled to the drum to rotate the drum.

The drum may fail to maintain dynamic balance because of the position of laundry stored therein, which may cause unintentional rotation of the drum.

Dynamic balance refers to a state of a rotating rotator in which centrifugal force or moment of centrifugal force becomes zero with respect to a rotation axis of the rotator. In the case of a rigid body, dynamic balance is maintained by constant mass distribution about a rotation axis.

Accordingly, with regard to a laundry treatment apparatus, dynamic balance may be understood as the case in which the mass distribution of laundry stored in a drum about a rotation axis of the drum falls within an acceptable range during rotation of the drum (i.e., the case in which the drum is rotated while undergoing vibration within an acceptable range).

On the other hand, failure of dynamic balance (i.e. unbalance) with regard to the aforementioned laundry treatment apparatus refers to a state in which the mass distribution about a rotation axis of the drum is not constant during rotation of the drum. This unbalance occurs when laundry is not uniformly distributed within the drum.

Rotation of the unbalanced drum causes vibration, and in turn noise is generated as vibration of the drum is transmitted to a tub or a cabinet.

Conventionally, to eliminate unbalance of the drum as described above, balancing units have been used in some laundry treatment apparatuses. These balancing units used in conventional laundry treatment apparatuses are of a ball balancer type or a fluid balancer type in which a housing coupled to a drum contains a ball or liquid.

The revolutions per minute of the unbalanced drum reaches a maximum when laundry, which causes the unbalanced state of the drum, passes the lowermost point of the rotation trace of the drum and reaches a minimum when the unbalance inducing laundry passes the uppermost point of the rotation trace of the drum.

Accordingly, the aforementioned ball balancers or fluid balancers used in conventional laundry treatment apparatuses are adapted to control unbalance as the ball or liquid moves toward the lowermost point of the rotation trace of the drum when the unbalance inducing laundry moves toward the uppermost point of the rotation trace of the drum.

Although the above described unbalance control method is available in a steady state in which vibration of the drum falls within a given range, it is impossible to anticipate the large effects of a transient state (i.e., in a transient vibration state) before vibration of the drum reaches the steady state.

Additionally, conventional balancing units have difficulty in actively eliminating unbalance as soon as unbalance occurs.

SUMMARY

Accordingly, the present invention is directed to a laundry treatment apparatus that substantially obviates one or more problems due to limitations and disadvantages of the related art.

One object of the present invention is to provide a laundry treatment apparatus which may actively eliminate dissymmetric rotation (i.e., unbalance) of a drum in which laundry is received.

Another object of the present invention is to provide a laundry treatment apparatus which may eliminate unbalance of a drum by supplying liquid into a device provided to agitate laundry stored in the drum.

A further object of the present invention is to provide a laundry treatment apparatus which may eliminate unbalance induced in a plane parallel to a diameter direction of a drum as well as unbalance induced in a plane parallel to a longitudinal direction of the drum.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treatment apparatus includes a cabinet including a laundry opening into which laundry having mass is introduced, a drum rotatably placed within the cabinet to store the laundry therein, the drum including a drum opening communicating with the laundry opening, and a balancing unit to attenuate unbalance of the drum caused by a nonuniform mass distribution of the laundry by locally increasing a load of the drum via a supply of liquid to the balancing unit.

The balancing unit may include a feeder to supply liquid, and at least three balancers mounted to the drum to store the liquid supplied from the feeder, the balancers being spaced equidistant apart from one another around a rotation center of the drum.

The balancing unit may further include a flow path structure mounted to the drum to guide the liquid supplied from the feeder such that the liquid moves to at least one balancer located in a direction opposite the nonuniform mass distribution of laundry.

The flow path structure may include a first flow path body extending from the drum to the feeder and thereafter bending toward the rotation center of the drum to define a space in which liquid is received, and one or more first flow path dividers to divide the space defined in the first flow path body into separate spaces equal in number to the balancers, the first flow path dividers allowing liquid introduced into a single space to be introduced only into one balancer.

The laundry treatment apparatus may further include a guide to direct the liquid supplied from the feeder into the first flow path body and to prevent the liquid supplied from the feeder from moving in a rotation direction of the drum or in a direction opposite to the rotation direction of the drum.

The guide may include a guide body extending from the drum and thereafter bending toward the first flow path body to define a space in which liquid is stored, and one or more guide dividers to divide the interior of the guide body into a plurality of spaces, the guide dividers temporarily preventing the liquid supplied from the feeder from moving in a rotation direction of the drum or in a direction opposite to the rotation direction of the drum in the interior of the guide body.

The laundry treatment apparatus may further include a sensing unit to sense a position of the nonuniform mass distribution of laundry inducing unbalance of the drum, and a controller to control the feeder such that liquid is supplied into the first flow path body while the drum is rotated by a predetermined supply angle after the drum is rotated by a predetermined standby angle from a point in time when the unbalance inducing laundry reaches the feeder.

The balancers may be spaced apart from one another by an angle of 120 degrees along the circumference of the drum, and the standby angle may be set to 60 degrees, and the supply angle may be set to 120 degrees.

The balancers may be spaced apart from one another by an angle of 90 degrees along the circumference of the drum, and the standby angle and the supply angle may be set to 90 degrees respectively.

The laundry treatment apparatus may further include a sensing unit to sense a position of the nonuniform mass distribution of laundry inducing unbalance of the drum, and a controller to control the feeder such that, when a predetermined standby time has passed after the unbalance inducing laundry reaches the feeder, liquid is supplied into the first flow path body for a predetermined supply time from a termination point of the standby time.

The laundry treatment apparatus may further include a drive unit including a stator, a rotor, to which a rotating shaft connected to the drum is coupled, and a plurality of permanent magnets attached to the rotor to rotate the rotor under influence of a magnetic field of the stator, and a sensing unit to sense magnetic force of the permanent magnets and to determine a position of the nonuniform mass distribution of laundry inducing unbalance of the drum, wherein the number of the first flow path dividers is equal to the number of the permanent magnets, or is half the number of the permanent magnets.

The sensing unit may detect a magnetic force of each permanent magnet passing the lowermost point of the rotation trace of the rotor, and the feeder may inject liquid to the guide passing the lowermost point of the rotation trace of the drum.

The balancing unit may include a plurality of balancers mounted to the drum to store liquid therein, the balancers being spaced apart from one another by the same angle around a rotation center of the drum, and each of the balancers may move liquid, supplied from an external source, from a center of the balancer to an edge of the balancer.

The balancing unit may include a feeder to supply liquid, and a flow path structure mounted to the drum to guide the liquid supplied from the feeder to the balancers.

The flow path structure may include a first flow path body extending from the drum to the feeder and thereafter bending toward the rotation center of the drum to define a space in which liquid is received, and one or more first flow path dividers to divide the space defined in the first flow path body into separate spaces equal in number to the balancers, the first flow path dividers allowing liquid introduced into a single space to be introduced only into one balancer.

Each of the balancers may include a receptacle mounted to an inner circumferential surface of the drum, the receptacle providing an inner space for storage of liquid, an inlet formed at the receptacle, into which the liquid guided via the first flow path dividers is introduced, and a guide plate to divide the inner space of the receptacle into an upper space facing the rotation center of the drum and a lower space facing the inner circumferential surface of the drum, the guide plate allowing the liquid introduced through the inlet to move from a center of the receptacle to an edge of the receptacle.

The balancer may further include an outlet to communicate the receptacle with the outside of the drum such that the liquid within the receptacle is discharged to the outside of the drum through the outlet.

In accordance with another aspect of the invention, a laundry treatment apparatus includes a cabinet including a laundry opening into which laundry having mass is introduced, a drum rotatably placed within the cabinet, the drum having a drum opening formed in a front surface thereof to communicate with the laundry opening, at least three balancers mounted to the drum and spaced apart from one another by the same angle around a rotation center of the drum, an inner space of each balancer being divided into a front space facing the front surface of the drum and a rear space facing a rear surface of the drum to store liquid therein, a flow path structure including a first flow path, divided into separate spaces equal in number to the balancers to supply liquid, introduced into one space, only to the rear space of one balancer, and a second flow path divided into separate spaces equal in number to the balancers to supply liquid, introduced into one space, only to the front space of one balancer, and a feeder configured to selectively supply liquid into the first flow path and the second flow path.

The balancers may protrude from an inner circumferential surface of the drum to agitate laundry within the drum during rotation of the drum.

The first flow path may include a first flow path body extending from the front surface of the drum to the feeder and thereafter bending toward the drum opening, and one or more first flow path dividers dividing the first flow path body into separate spaces equal in number to the balancers, the first flow path dividers penetrating the front surface of the drum to allow liquid, introduced into one space, to be supplied only into the rear space of one balancer, and the second flow path may include a second flow path body extending from the front surface of the drum and thereafter bending toward the drum opening, the second flow path body being spaced apart from an outer circumferential surface of the first flow path body by a prescribed distance, and one or more second flow path dividers dividing the second flow path body into separate spaces equal in number to the balancers, the second flow path dividers penetrating the front surface of the drum to allow liquid, introduced into one space, to be supplied only into the front space of one balancer.

The laundry treatment apparatus may further include a first guide located between the first flow path and the drum opening, the first guide serving to guide the liquid supplied from the feeder to the first flow path body and to prevent the liquid supplied from the feeder from moving in a direction opposite to a rotation direction of the drum, and a second guide mounted to the first flow path body, the second guide serving to guide the liquid supplied from the feeder to the second flow path body and to prevent the liquid supplied from the feeder from moving in a direction opposite to a rotation direction of the drum.

Each of the balancers may include a receptacle mounted to an inner circumferential surface of the drum, the receptacle providing an inner space for storage of liquid, a receptacle partition to divide the inner space of the receptacle into the front space and the rear space, a guide plate located above the receptacle partition to divide the front space into an upper space facing the rotation center of the drum and a lower space facing the inner circumferential surface of the drum, and a first inlet to supply the liquid introduced through the first flow path to a space above the guide plate, and a second inlet to supply the liquid introduced through the second flow path to a space below the guide plate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
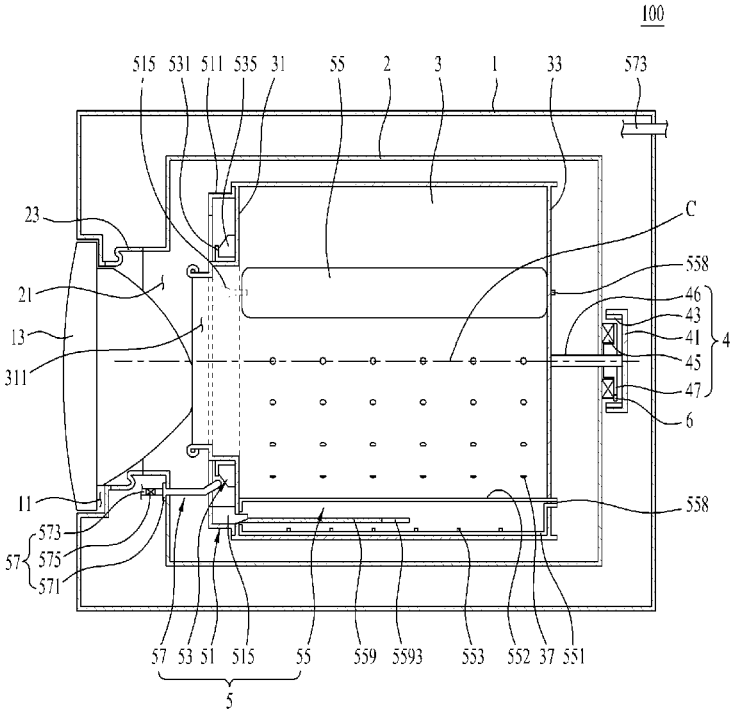
FIG. 1 is a sectional view of a laundry treatment apparatus according to one embodiment of the present invention.

Hereinafter, exemplarily embodiments of the present invention will be described in detail with reference to the accompanying drawings. A configuration of an apparatus that will be described hereinafter and a control method of the apparatus are provided for explanation of the exemplarily embodiments of the present invention and are not intended to limit the technical scope of the present invention. The same reference numerals of the entire specification designate the same constituent elements.

As exemplarily shown in FIG. 1, a laundry treatment apparatus of one embodiment of the present invention, designated by reference numeral 100, includes a cabinet 1 defining an external appearance of the apparatus 100, a tub 2 placed within the cabinet 1 and configured to store wash water therein, a drum 3 rotatably placed within the tub 2 and configured to store laundry therein, a drive unit 4 to rotate the drum 3, and a balancing unit 5 to control unbalance of the drum 3 by increasing the weight of a drum region opposite to laundry that induces unbalance of the drum 3 (hereinafter referred to as "unbalance inducing laundry").

FIG. 1 shows the laundry treatment apparatus 100 configured to implement only washing of laundry using water. It will be appreciated that a laundry treatment apparatus capable of washing and drying laundry must further include an air supply device (not shown) installed within the cabinet 1 to supply air into the drum 3.

Additionally, it will be appreciated that a laundry treatment apparatus used only to dry laundry must include an air supply device (not shown) to supply air into the drum 3, although removing the tub 2 exemplarily shown in FIG. 1 from the laundry treatment apparatus is permissible.

Hereinafter, for convenience of description, a configuration of the laundry treatment apparatus 100 that implements only washing as exemplarily shown in FIG. 1 will be described.

The cabinet 1 includes a laundry opening 11 for introduction and removal of laundry, and a door 13 rotatably installed to the cabinet 1 to open or close the laundry opening 11.

The tub 2 may have a hollow cylindrical shape, and has a tub opening 21 communicating with the laundry opening 11.

A gasket 23 is interposed between the tub opening 21 and the laundry opening 11. The gasket 23 serves not only to prevent wash water stored in the tub 2 from leaking from the tub 2, but also to prevent vibration of the tub 2 from being transferred to the cabinet 1.

The drum 3 may include a hollow cylindrical shape and may be placed within the tub 2.

The drum 3 has a drum opening 311 formed in a front surface 31 thereof to communicate with the laundry opening 11 and the tub opening 21, and a plurality of through-holes 37 perforated in the circumference of the drum 3 to communicate the interior of the drum 3 with the interior of the tub 2.

Accordingly, a user may place laundry into or retrieve laundry from the drum 3 through the laundry opening 11. Additionally, through the through-holes 37, wash water stored in the tub 2 may move to laundry stored in the drum 3 and wash water extracted from laundry may be discharged into the tub 2.

The drive unit 4 may have various shapes capable of rotating the drum 3 within the tub 2. FIG. 1 shows a direct connection motor by way of example, which is installed to a rear surface of the tub 2 to rotate the drum 3 via a rotating shaft penetrating the rear surface of the tub 2.

As exemplarily shown in FIG. 1, the drive unit 4 may include a stator 45 coupled to the rear surface of the tub 2, a rotating shaft 46 penetrating the rear surface of the tub 2 and coupled to a rear surface 33 of the drum 3, a rotor 41 configured to surround the stator 45 and connected to the rotating shaft 46, and a plurality of permanent magnets 43 attached to the rotor 41 to cause rotation of the rotor 41 under the influence of a magnetic field created by the stator 45.

Figure 2:
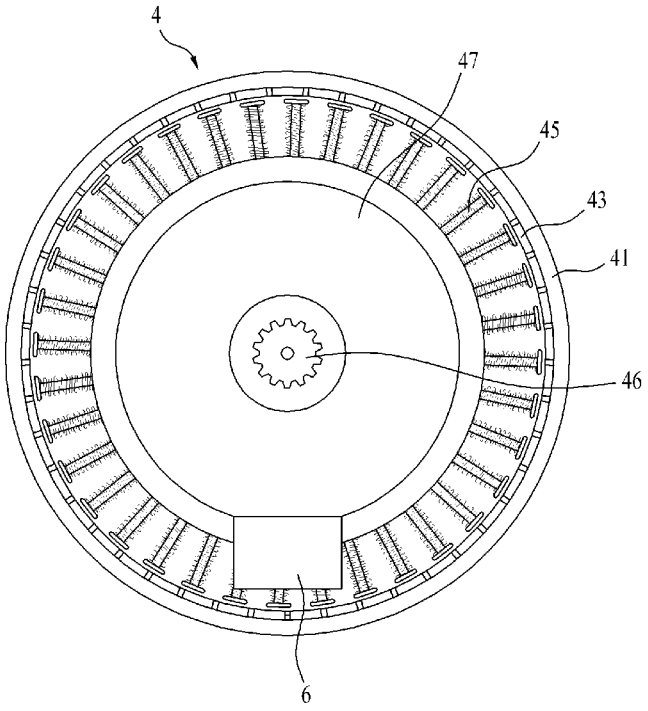
FIG. 2 shows a drive unit and a sensing unit according to one embodiment of the present invention.

As exemplarily shown in FIG. 2, the plurality of permanent magnets 43 is attached to an inner circumferential surface of the rotor 41 at a constant interval, and the stator 45 is surrounded by an insulator 47.

The insulator 47 may be provided with a sensing unit 6 (e.g., a Hall sensor) to sense the revolutions per minute, rotation direction, and rotation angle of the rotor 41 by sensing magnetic force of the permanent magnets 43. A description related to the sensing unit 6 will follow.

The balancing unit 5 serves to attenuate unbalance of the drum 3 by increasing the weight of a drum region symmetrical to a drum region in which unbalance inducing laundry is located on the basis of the rotation center of the drum 3.

The balancing unit 5 may be located at the front surface 31 of the drum 3 or may be located at the rear surface 33 of the drum 3. Note that, for convenience of description, the following description will be based on the balancing unit 5 being located at the front surface 31 of the drum 3, although this configuration should not be interpreted as limiting the invention.

Figure 3:
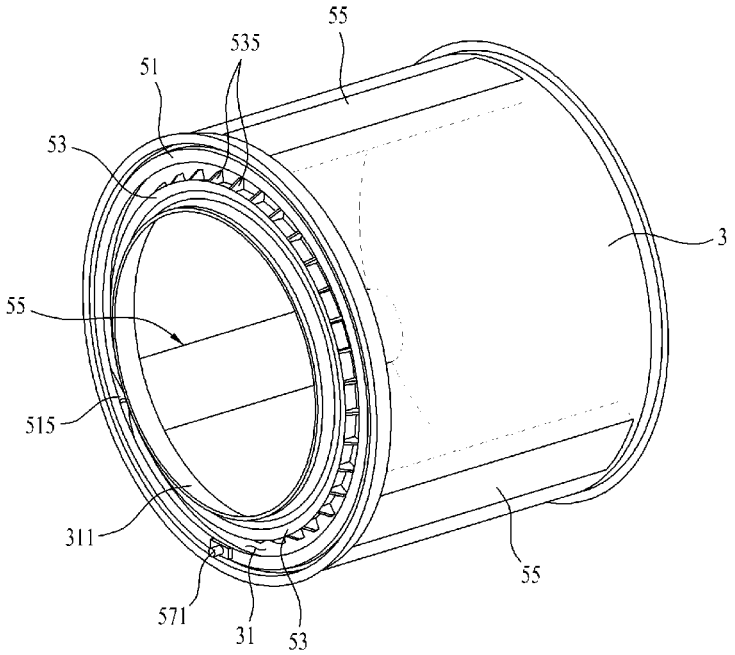
FIG. 3 shows the coupling relationship between a drum and a balancing unit according to one embodiment of the present invention.

As exemplarily shown in FIG. 3, the balancing unit 5 includes at least three balancers 55 mounted to the drum 3 so as to be equidistantly spaced apart from one another, a feeder 57 mounted to the tub 2 or the gasket 23 to inject liquid toward the front surface 31 of the drum 3, and a flow path structure 51 mounted to the front surface 31 of the drum 3 to guide the liquid injected from the feeder 57 to the balancers 55.

The number of the balancers 55 may be selected in various ways so long as the balancers 55 are spaced apart from one another by the same angle along the circumference of the drum 3. Note that, for convenience of description, the following description will be based on three or four balancers 55 being provided, although this configuration should not be interpreted as limiting the invention.

As exemplarily shown in FIG. 3, the balancers 55 may protrude from an inner circumferential surface of the drum 3, although the balancers 55 may be mounted to an outer circumferential surface of the drum 3.

The balancers 55 according to one embodiment of the present invention, protrude from the inner circumferential surface of the drum 3, may function not only to eliminate unbalance of the drum 3, but also to agitate laundry stored in the drum 3 during rotation of the drum 3. Accordingly, the following description will be based on the balancers 55 being arranged at the inner circumferential surface of the drum 3, although this configuration should not be interpreted as limiting the invention.

Figure 4:
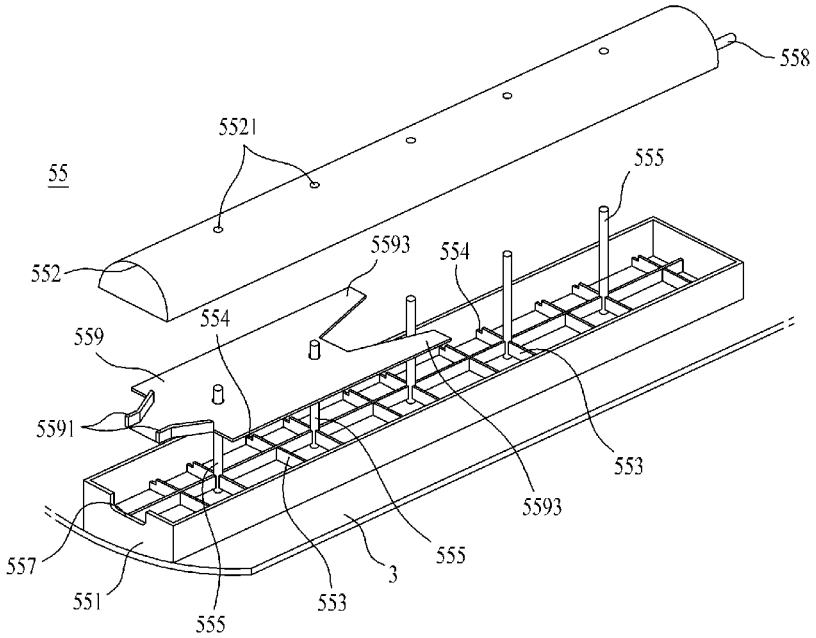
FIG. 4 shows a balancer according to one embodiment of the present invention.

As exemplarily shown in FIG. 4, each of the balancers 55 includes a receptacle 551/552 in which liquid is stored, the receptacle 551/552 being mounted to the inner circumferential surface of the drum 3, an inlet 557 through which liquid is introduced into the receptacle 551/552, and an outlet 558 through which the interior of the receptacle 551/552 communicates with the outside of the drum 3 such that the liquid stored in the receptacle 551/552 is discharged to the outside of the drum 3.

The receptacle may be comprised of a receptacle body 551 mounted to the inner circumferential surface of the drum 3 and a cover 552 coupled to the top of the receptacle body 551.

The cover 552 may maintain a constant distance from the receptacle body 551 by fixing pieces 555 arranged in the receptacle body 551. The outlet 558, through which the liquid stored in the receptacle body 551 is discharged to the outside of the drum 3, may be formed at the cover 552.

The receptacle body 551 and the cover 552 may be coupled to each other via fastening members, such as bolts. To this end, the cover 552 has fastening member passage holes 5521, through which the fastening members may penetrate the cover 552 and be inserted into the fixing pieces 555.

Additionally, the balancer 55 may further include a guide plate 559 configured to divide the interior of the receptacle 551/552 into an upper space facing the rotation center of the drum 3 and a lower space facing the circumference of the drum 3.

Assuming that unbalance of the drum 3 (i.e., unbalance in a plane parallel to a longitudinal direction of the drum 3) is induced as laundry accumulates at the front surface 31 of the drum 3, the absence of the guide plate 559 may cause liquid introduced into the receptacle 551/552 to fill a front compartment of the receptacle 551/552 and thereafter move to a rear compartment. This movement of liquid has a risk of intensifying unbalance of the drum 3.

Accordingly, to prevent the above described problem, the guide plate 559 may guide liquid introduced into the receptacle 551/552 through the inlet 557 such that the liquid moves from the center of the receptacle body 551 to the edge of the receptacle body 551.

The guide plate 559 has the same width as the receptacle body 551, but has a length less than the receptacle body 551 (e.g., a length corresponding to half the length of the receptacle body 551).

In addition, the guide plate 559 may be located at a height equal to or less than a height of the inlet 557. The guide plate 559 may have guide ribs 5591 connected to the inlet 557 to guide liquid introduced into the inlet 557.

The guide plate 559 may further have a pair of extensions 5593, which are formed at one side thereof opposite the guide ribs 5591, extending towards the rear surface 33 of the drum 3. Preferably, the extensions 5593 may be spaced apart from each other by a prescribed distance.

The receptacle body 551 may include receptacle partitions 553 to divide an inner space of the receptacle body 551 into a plurality of spaces in a direction parallel to a rotation axis of the drum 3 (i.e., in a longitudinal direction of the drum 3 or in a longitudinal direction of the receptacle 551/552), and communication holes 554 formed in the receptacle partitions 553 to communicate the respective spaces divided by the receptacle partitions 553 with one another.

As the guide plate 559 causes the liquid introduced into the receptacle 551/552 to move from the center of the receptacle body 551 to the edge of the receptacle body 551 at a reduced flow rate, it is possible to prevent the liquid introduced into the receptacle 551/552 from intensifying the unbalance of the drum 3 even when laundry accumulates at the front surface 31 of the drum 3.

Figure 13:
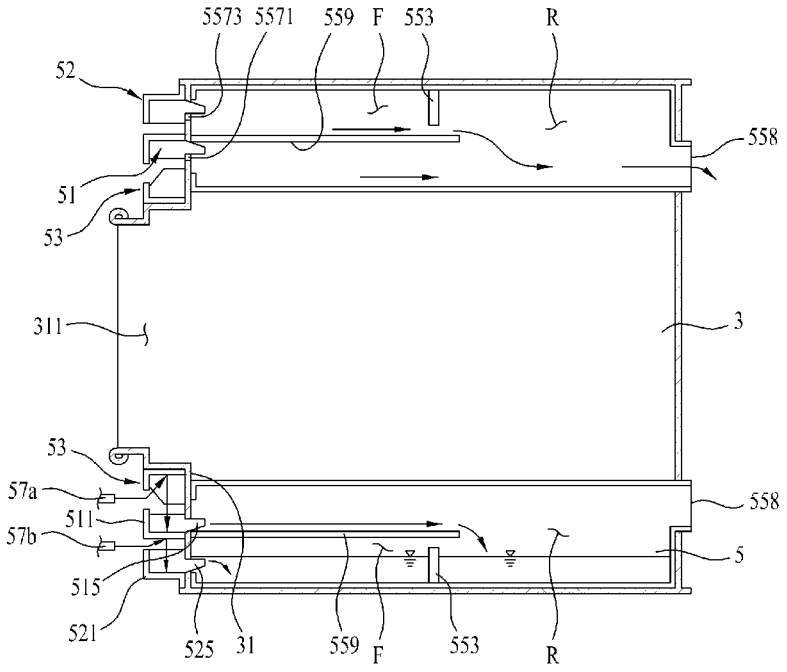
FIG. 13 shows another embodiment of the present invention.

The flow path structure may include only a first flow path 51 coupled to the front surface 31 of the drum 3 as exemplarily shown in FIGS. 5*a* and 5*b*, or may include a first flow path 51 and a second flow path 52 coupled to the front surface 31 of the drum 3 as exemplarily shown in FIG. 13.

First, provision of the first flow path 51 alone will be described with reference to FIGS. 5*a* and 5*b*. The first flow path 51 may include a first flow path body 511, which extends from the front surface 31 of the drum 3 and bends toward the drum opening 311 such that a liquid storage space is defined inside the first flow path body 511, and first flow path dividers 515 arranged to divide the space inside the first flow path body 511 into plural spaces S1, S2, and S3 equal in number to the balancers 55.

The first flow path body 511 takes the form of a ring, a diameter of which is greater than a diameter of the drum opening 311 such that the circumference of the drum opening 311 is seated inside the first flow path body 511. As such, the first flow path body 511 is coupled to the front surface 31 of the drum 3.

More specifically, the first flow path body 511 may be comprised of a first ring-shaped body 5111 coupled to the front surface 31 of the drum 3, a diameter of the first body 5111 being greater than a diameter of the drum opening 311, and a first flange 5113 extending from the first body 5111 toward the drum opening 311 (i.e., toward the rotation center of the drum 3).

With the above described configuration, liquid supplied to the first flow path 51 via the feeder 57 may be stored in a space defined between the front surface 31 of the drum 3 and the first flow path body 511.

Figure 5:
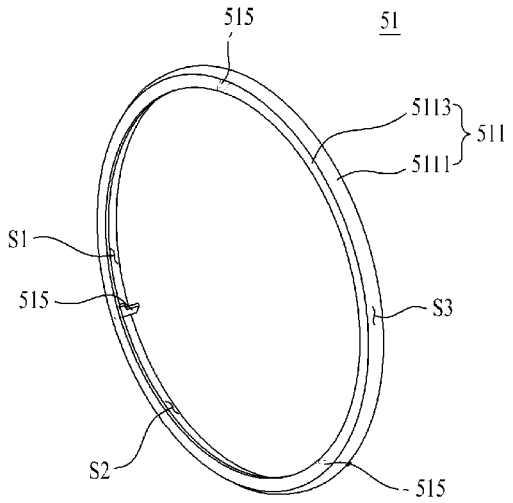
FIGS. 5*a* and 5*b* show a flow path structure according to one embodiment of the present invention.
Figure 5:
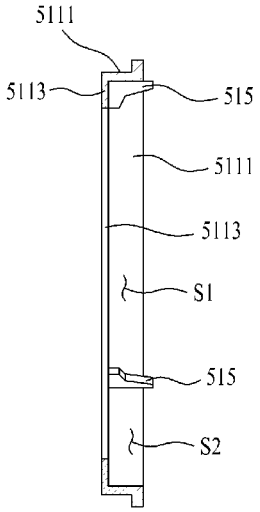

Although FIG. 5 shows a configuration in which the first body 5111 and the first flange 5113 are coupled to each other at a right angle, it will be appreciated that this is provided by way of example and a coupling angle between the first body 5111 and the first flange 5113 may be changed in various ways.

Meanwhile, as described above, the number of the balancers 55 may be selected in various ways so long as the balancers 55 are spaced apart from one another by the same angle along the circumference of the drum 3. The number of the first flow path dividers 515 is equal to the number of the balancers 55.

More specifically, in one example, if the balancers 55 are equidistantly arranged on the circumference of the drum 3 by an angle of 120 degrees on the basis of the rotation center of the drum 3, the first flow path dividers 515 may be provided to divide the space inside the first flow path body 511 into three spaces S1, S2, and S3. In another example, if the balancers 55 are equidistantly arranged on the circumference of the drum 3 by an angle of 90 degrees around the rotation center of the drum 3, the first flow path dividers 515 may be provided to divide the space inside the first flow path body 511 into four spaces.

Note that, for convenience of description, the following description will be based on three balancers 55 and three first flow path dividers 515 being provided, although this configuration should not be interpreted as limiting the invention.

Figure 7:
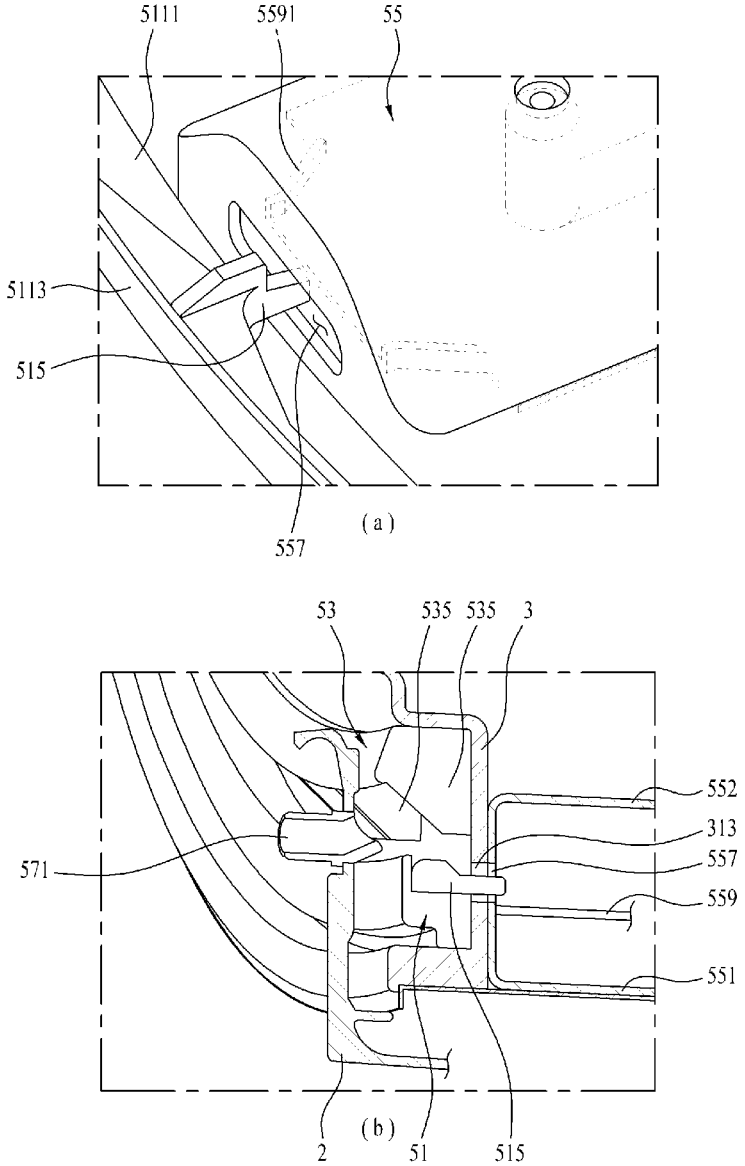
FIGS. 7*a* and 7*b* show the coupling relationship between the flow path structure, the guide, and the balancer according to one embodiment of the present invention.

The first flow path dividers 515 are inserted into divider penetration holes (313, see FIG. 7(*b*)) formed in the front surface 31 of the drum 3. The divider penetration holes 313 are formed respectively to communicate the inlets 557 of the balancers 55 with the outside of the drum 3.

Accordingly, liquid introduced into one space S1 defined inside the first flow path body 511 may be supplied only to one of the three balancers 55, liquid introduced into the second space S2 may be supplied only to one of the other two balancers 55, and liquid introduced into the third space S3 may be supplied to the final remaining balancer 55.

The feeder 57 may include a nozzle 571 mounted to the tub 2 or the gasket 23 to supply liquid to the first flow path 51, a feed pipe 573 to supply liquid to the nozzle 571, and a valve 575 to open or close the feed pipe 573 under control of a controller (not shown) (see FIG. 1).

If liquid supplied to the first flow path 51 is water, the feed pipe 573 may connect the nozzle 571 and a water supply source (not shown) provided at the outside of the cabinet 1 to each other.

In addition, the feed pipe 573 may diverge from a water supply pipe (not shown) that connects the tub 2 and the water supply source (not shown) to each other to supply wash water into the tub 2.

In one embodiment of the present invention, the balancing unit 5 may further include a guide 53 mounted to the drum 3 to prevent liquid injected from the feeder 57 from moving in a rotation direction of the drum 3 or in a direction opposite to the rotation direction.

Unbalance is mass dissymmetry beyond an acceptable range that occurs in the drum 3 during rotation of the drum 3. Therefore, in order to attenuate unbalance of the drum 3, the feeder 57 may supply liquid into the balancer 55 located at a specific position through the first flow path 51 during rotation of the drum 3 (to locally increase the load of the drum 3).

Meanwhile, when liquid is supplied to the first flow path 51 during rotation of the drum 3, liquid stored in the space inside the first flow path body 511 may move in a rotation direction of the drum 3 or in a direction opposite to the rotation direction (in other words, the first flow path body 511 may slip from the front surface 31 of the drum 3).

When liquid injected from the feeder 57 moves in a rotation direction of the drum 3 or in a direction opposite to the rotation direction, the liquid may be supplied into an unintentional space among the plural spaces S1, S2, and S3 defined in the flow path 51, which has a risk of intensifying unbalance of the drum 3. The guide 53 serves to solve the above described problem.

Figure 6:
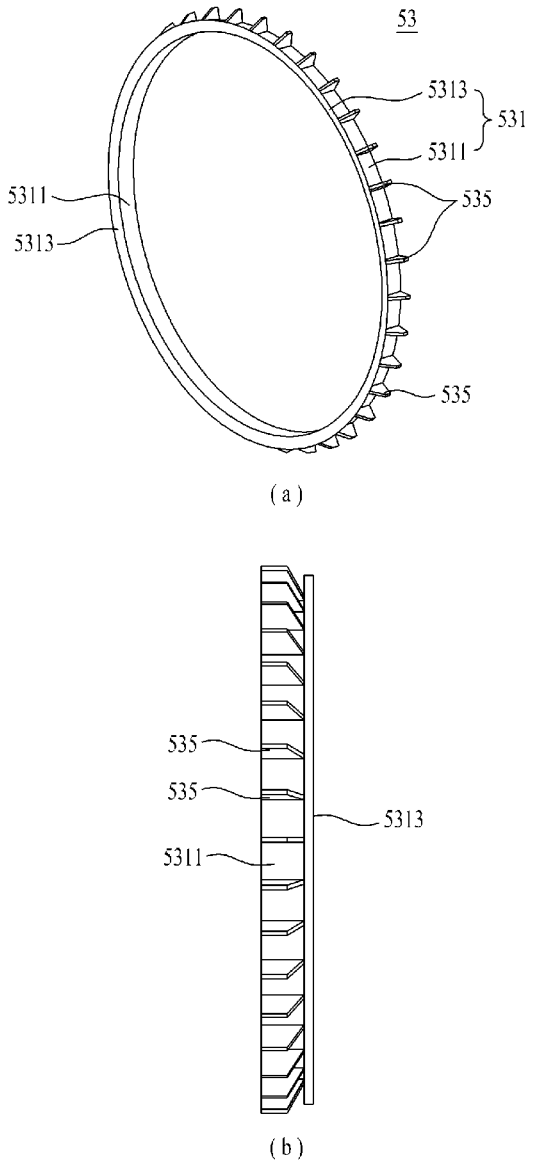
FIGS. 6*a* and 6*b* show a guide according to one embodiment of the present invention.

As exemplarily shown in FIGS. 6*a* and 6*b*, the guide 53 may include a guide body 531, which extends from the front surface 31 of the drum 3 and bends toward the first flow path 51, and guide dividers 535 to divide an inner space of the guide body 531 into a plurality of spaces.

The guide body 531 is comprised of a body 5311 coupled to the front surface 31 of the drum 3, the body 5311 taking the form of a ring, a diameter of which is greater than a diameter of the drum opening 311 and is less than a diameter of the first flow path 51, and a flange 5313 extending from the body 5311 toward the first flow path 51 (in a direction away from the drum opening 311).

The body 5311 may be spaced apart from the first flow path 51 by a prescribed distance, and liquid injected from the feeder 57 may be supplied to the first flow path 51 after colliding with the guide 53. Accordingly, the flange 5313 serves to guide the liquid, injected from the feeder 57 toward the body 5311, to move to the first flow path 51.

The plurality of guide dividers 535 may be arranged at equidistants on the circumference of the guide body 531. Preferably, the nozzle 571 may inject liquid toward the guide 53.

That is, the nozzle 571 may be configured to extend from the tub 2 or the gasket 23 toward the front surface 31 of the drum 3 and bend toward the guide 53 by a prescribed angle, so as to inject liquid into separate spaces defined between the guide dividers 535.

The number of the guide dividers 535 may be equal to the number of the permanent magnets 43 included in the drive unit 4, or may be half the number of the permanent magnets 43.

With regard to the sensing unit 6 used to sense the revolutions per minute, rotation angle and rotation direction of the drum 3, angular resolution of the sensing unit 6 is decided based on the number of the permanent magnets 43 of the drive unit 4.

This is because the sensing unit 6 may transmit data related to whether or not the permanent magnets 43 have passed the sensing unit 6 during rotation of the rotor 41 (during rotation of the drum 3) to the controller (not shown), and the controller (not shown) may determine the revolutions per minute of the rotor 41 (the revolutions per minute of the drum 3) based on a time interval between data transmissions from the sensing unit 6 and also determine the rotation angle of the rotor 41 (the rotation angle of the drum 3) based on the number of times data is transmitted from the sensing unit 6 or a data transmission sequence.

Accordingly, angular resolution of the sensing unit 6 may be understood as the minimum rotation angle of the rotor 41 that is detectable by the sensing unit 6.

Meanwhile, once unbalance of the drum 3 has occurred, the revolutions per minute of the drum 3 reach minimum at the uppermost point of the rotation trace of the drum 3 and reach maximum at the lowermost point of the rotation trace of the drum 3. Accordingly, the controller (not shown) may determine that unbalance inducing laundry accumulates at a region of the drum 3 exhibiting the maximum revolutions per minute (i.e., a region opposite to a region of the drum 3 exhibiting the minimum revolutions per minute).

If the number of the guide dividers 535 is equal to the number of the permanent magnets 43, under control of the controller (not shown), liquid directed from the feeder 57 to the first flow path 51 may be accurately supplied to the balancer 55 located opposite to a drum region in which unbalance inducing laundry accumulates.

On the other hand, if the number of the guide dividers 535 is half the number of the permanent magnets 43, active unbalance control is possible as experimentally proven, although accuracy with regard to supplying liquid, directed from the feeder 57 to the first flow path 51, to the balancer 55 located opposite to a drum region in which unbalance inducing laundry accumulates is somewhat deteriorated.

Meanwhile, the feeder 57 may be installed at any position of the tub 2 or the gasket 23 so long as the feeder 57 is capable of supplying liquid toward the guide 53.

Preferably, both the sensing unit 6 and the feeder 57 are located in a plane which extends in a longitudinal direction of the drum 3 and contains a rotation axis (C, see FIG. 1) of the drum 3.

For example, the sensing unit 6 may be located to sense magnetic force of the permanent magnet 43 passing the lowermost point of the rotation trace of the rotor 41, and the feeder 57 may be located to supply liquid to the lowermost point of the rotation trace of the drum 3.

Figure 8:
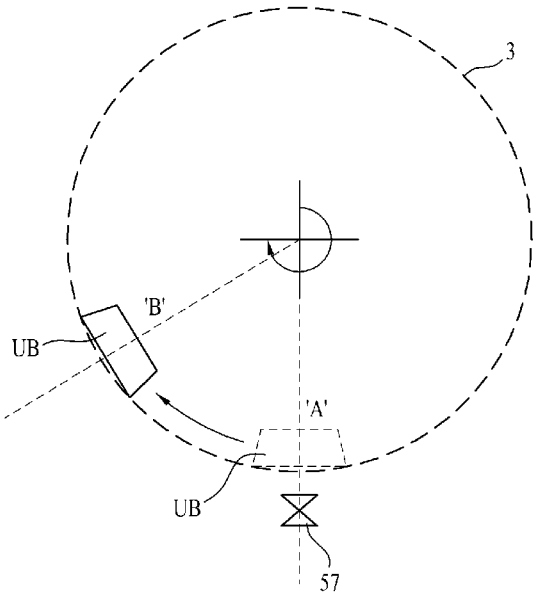
FIGS. 8*a* and 8*b* show an unbalance attenuation control process according to one embodiment of the present invention.
Figure 8:
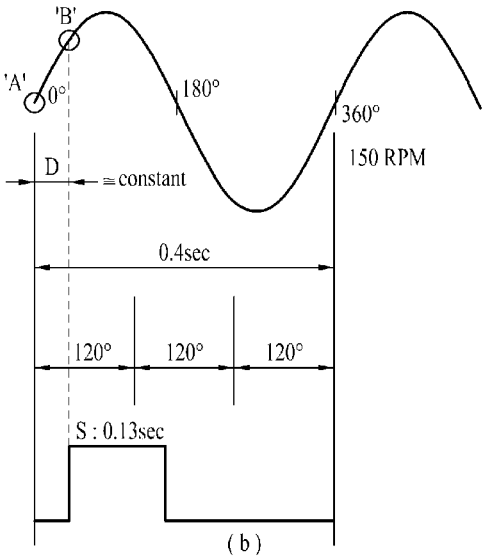

As exemplarily shown in FIG. 8, when the drum 3 is rotated by a given angle B from a point in time A when unbalance inducing laundry UB passes the nozzle 571, the controller (not shown) according to the present invention may control supply of liquid such that liquid is supplied to the first flow path 51 for a predetermined time (i.e. while the drum 3 is rotated by a predetermined angle) so as to attenuate unbalance of the drum 3. The above described positions of the sensing unit 6 and the feeder 57 may facilitate this control of the controller (not shown).

Hereinafter, a control process according to one embodiment of the present invention will be described with reference to FIGS. 9 to 12.

Figure 9:
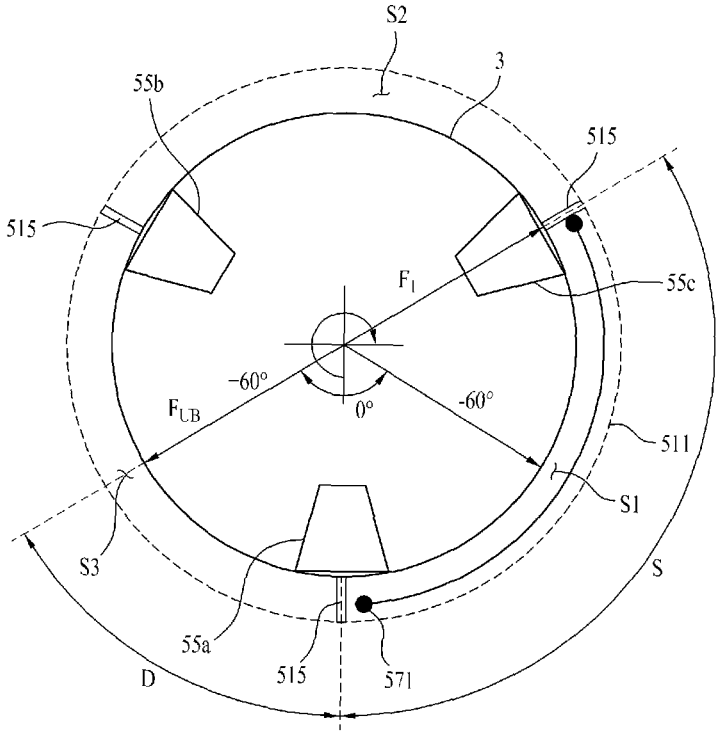
FIG. 9 shows an unbalance attenuation control process in a first circumstance.

FIG. 9 shows an unbalance attenuation control process when unbalance inducing laundry UB is located between a first balancer 55*a* and a second balancer 55*b* (more particularly, at an angular position of 60 degrees).

During rotation of the drum 3, the controller (not shown) determines a drum region where the unbalance inducing laundry UB is located by measuring the revolutions per minute of the drum 3 based on data provided by the sensing unit 6.

Thereafter, the controller determines whether or not the unbalance inducing laundry UB has passed a position where the nozzle 571 is located.

If the unbalance inducing laundry UB has passed the nozzle 571, the controller determines whether or not the drum 3 is rotated by a predetermined standby angle D.

If the drum 3 reaches the standby angle D, the controller opens the valve 575 of the feeder 57 to allow the nozzle 571 to inject liquid toward the guide 53. In this case, the controller controls the feeder 57 to supply liquid to the first flow path 51 until the drum 3 is rotated by a predetermined supply angle S.

Assuming that three balancers 55 are arranged on the circumference of the drum 3 (i.e., the balancers 55 being spaced apart from one another by an angle of 120 degrees), the standby angle D and the supply angle S may be set in various ways to ensure that a given amount of liquid is supplied to the respective balancers 55 at a given ratio.

That is, when attempting to minimize the supply amount of liquid of the nozzle 571 per unit time, the standby angle D may be set to 60 degrees and the supply angle S may be set to 120 degrees. On the other hand, when attempting to increase the supply amount of liquid of the nozzle 571, the standby angle D may be set to a greater value and the supply angle S may be set to a smaller value.

Alternatively, assuming that the balancers 55 are equidistantly spaced apart from one another by an angle of 90 degrees along the circumference of the drum 3, the standby angle D and the supply angle S may both be set to 90 degrees. Assuming that the balancers 55 are equidistantly spaced apart from one another by an angle of 60 degrees along the circumference of the drum 3, the standby angle D and the supply angle S may be set to 120 degrees and 60 degrees respectively.

Additionally, assuming that the balancers 55 are equidistantly spaced apart from one another by an angle of 45 degrees along the circumference of the drum 3, the standby angle D and the supply angle S may be set respectively to 135 degrees and 45 degrees. Assuming that the balancers 55 are equidistantly spaced apart from one another by an angle of 36 degrees along the circumference of the drum 3, the standby angle D and the supply angle S may be set respectively to 144 degrees and 36 degrees.

For convenience of description, the following description will be described based on the supply amount of liquid of the nozzle 571 per unit time being set to an amount to fill a second balancer with liquid by supplying liquid until the second balancer reaches the nozzle 571 after a first balancer passes the nozzle 571, although this configuration should not be interpreted as limiting the invention.

That is, the supply amount of liquid of the nozzle 571 per unit time that will be described hereinafter is variably set, based on the revolutions per minute of the drum 3, to an amount to fill a second balancer with liquid as liquid is supplied until the second balancer reaches the nozzle 571 after a first balancer passes the nozzle 571.

As exemplarily shown in FIG. 9, when laundry accumulates at the middle between the first balancer 55*a* and the second balancer 55*b*, attenuation of unbalance inducing force $F_{UB}$ may require supply of liquid only to a third balancer 55*c*.

That is, to control unbalance of the drum 3, it is necessary to supply liquid, supplied to the first flow path 51 via the nozzle 517, only into the first space S1 of the first flow path body 511.

To this end, the controller (not shown) controls the nozzle 571 to supply liquid to the first flow path 51 until the drum 3 is rotated by 120 degrees from a point in time when unbalance inducing laundry massed in a partial region of the drum 3 (unbalance inducing force $F_{UB}$) is rotated by an angle of 60 degrees from the nozzle 571.

The liquid, injected from the nozzle 571 to the first flow path 51, is temporarily stored in the first flow path 51 by centrifugal force. Then, while the third balancer 55*c* passes the lowermost point of the rotation trace of the drum 3 (i.e., a position where the nozzle 571 is located), the liquid is supplied into the third balancer 55*c* under guidance of the first flow path divider 515 corresponding to the third balancer 55*c* by the weight thereof.

Meanwhile, since the guide dividers 535 temporarily prevent the liquid injected from the nozzle 571 from moving in a rotation direction of the drum 3 or in a direction opposite to the rotation direction, according to the present invention, it is possible to prevent the liquid injected from the nozzle 571 from being introduced into an unintentional space S2 or S3 among the spaces S1, S2, and S3 defined in the first flow path body 511.

In this way, the present invention has the effect of providing the laundry treatment apparatus 100 capable of actively eliminating unbalance of the drum 3 and agitating laundry within the drum 3.

Meanwhile, the liquid supplied into the third balancer 55*c* is discharged to the outside of the drum 3 through the outlet 558, which may serve to prevent the liquid from being directed to laundry stored in the drum 3.

In summary, the liquid injected from the nozzle 571 is supplied into the third balancer 55*c* while the third balancer 55*c* is moved toward the lowermost point of the rotation trace of the drum 3. Then, while the third balancer 55*c* is moved toward the uppermost point of the rotation trace of the drum 3, the liquid is discharged from the drum 3 into the tub 2 through the outlet 558 via rotation of the drum 3.

This is because attenuation of unbalance is possible only when the liquid supplied into the balancer 55 is stored in the balancer 55 for a given time. This storage of liquid is possible because the outlet 558 formed in the balancer 55 is located higher than the guide plate 559 (i.e., the outlet 558 being formed in the cover 552).

Figure 10:
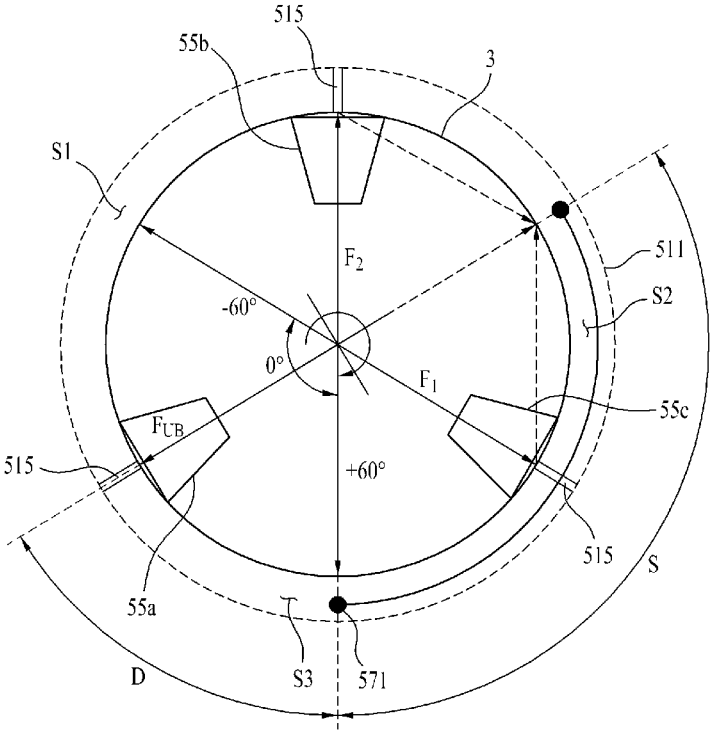
FIG. 10 shows an unbalance attenuation control process in a second circumstance.

FIG. 10 shows an unbalance attenuation control process when unbalance inducing force $F_{UB}$ (unbalance inducing laundry) is applied to the first balancer 55*a*.

In the case of FIG. 10, attenuation of unbalance of the drum 3 may require supply of the same amount of liquid into the second balancer 55*b* and the third balancer 55*c*.

To this end, the controller (not shown) determines whether or not the drum 3 is rotated by the standby angle D after unbalance inducing laundry $F_{UB}$ passes the nozzle 571, and supplies liquid to the first flow path 51 while the drum 3 is rotated by the supply angle S from a point in time when the unbalance including laundry $F_{UB}$ passes the nozzle 571.

The first flow path dividers 515 formed at the first flow path 51 divide the space inside the first flow path body 511 into separate spaces equal in number to the balancers 55, and positions of the respective first flow path dividers 515 are equal to positions of the inlets 557 of the balancers 55.

Accordingly, liquid supplied from the nozzle 571 while the drum 3 is rotated by the supply angle S (a range of symmetrical angles on the basis of the first flow path divider 515) from a point in time when the drum 3 is rotated by the standby angle D may be supplied into the third space S3 and the second space S2 of the first flow path body 511 by the same amount.

As the liquid supplied into the third space S3 is introduced into the third balancer 55*c* and the liquid supplied into the second space S2 is introduced into the second balancer 55*b*, the unbalance inducing force $F_{UB}$ may be reduced or removed by the weights F2 and F1 of liquid supplied into the second balancer 55*b* and the third balancer 55*c*.

Meanwhile, when three balancers 55 are spaced apart from one another by an angle of 120 degrees, regardless of the position of the unbalance inducing laundry $F_{UB}$ as exemplarily shown in FIG. 10, the standby angle D may be set to 60 degrees and the supply angle S may be set to 120 degrees.

Figure 12:
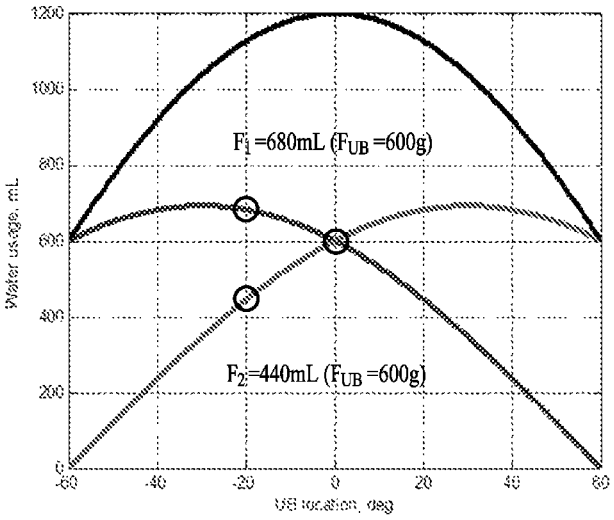
FIGS. 12*a* and 12*b* show graphs regarding, respectively, water usage and balancing participation ratio versus the location of the unbalance for an unbalance attenuation process according to one embodiment of the present invention.
Figure 12:
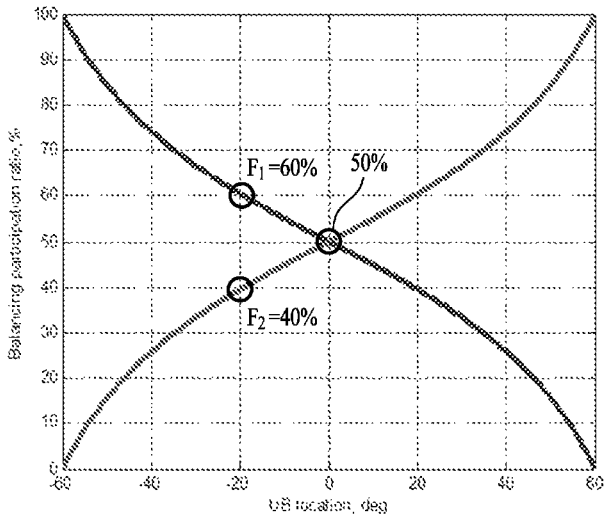

As will be appreciated from the graph of FIG. 12, in consideration of the amount of liquid supplied into each balancer (FIG. 12(*a*)) and the proportion of unbalance inducing force $F_{UB}$ to be removed by each balancer (FIG. 12(*b*)), in the case in which control of unbalance needs to supply liquid into two balancers, the unbalance inducing force $F_{UB}$ may be removed only by supplying liquid into the two balancers respectively at a given ratio.

Meanwhile, in the case in which the supply amount of liquid of the nozzle 571 per unit time is set to an amount to fill a second balancer with liquid by supplying liquid until the second balancer reaches the nozzle 571 after a first balancer passes the nozzle 571, the standby angle D and the supply angle S, which are set with regard to the case of controlling unbalance by supplying liquid into only one balancer (FIG. 9), satisfy the condition of FIG. 12 under the situation of FIG. 10.

Accordingly, in the present invention, the standby angle D and the supply angle S, which are set with regard to the case of controlling unbalance by supplying liquid into two balancers (FIG. 10), may be equal to those of the case of controlling unbalance by supplying liquid into only one balancer (FIG. 9).

In conclusion, the laundry treatment apparatus 100 of the present invention may be controlled in a simplified manner and may control unbalance of the drum 3, regardless of a position of unbalance inducing force $F_{UB}$, even when a point in time to supply liquid and a liquid supply time of the nozzle 571 are controlled based on the rotation angle of the drum 3.

Note that the standby angle D and the supply angle S may be set differently from the above description based on the supply amount of liquid of the feeder 57 per unit time. The supply angle S may be set to a range of symmetrical angles on the basis of the first flow path divider 515, and the standby angle D may be set to an angle required until unbalance inducing laundry reaches the supply angle S after passing the nozzle 571.

For example, in the case of FIG. 10, if the supply angle S is set to 60 degrees, which is the sum of symmetrical angles on the basis of the first flow path divider 515 (i.e., an angle from −30 degrees to +30 degrees on the basis of the first flow path divider 515), the standby angle D may be 90 degrees.

Figure 11:
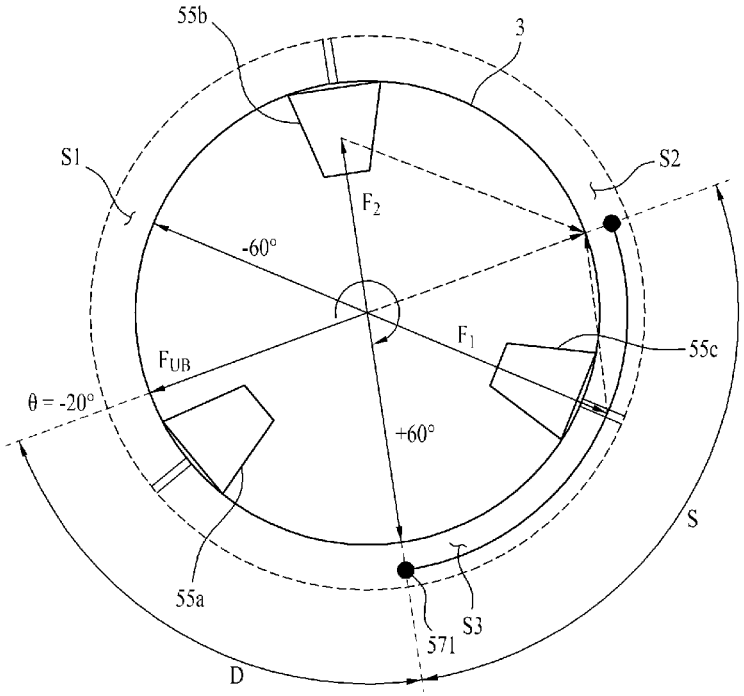
FIG. 11 shows an unbalance attenuation control process in a third circumstance.

FIG. 11 shows an unbalance attenuation control process in the case in which unbalance inducing force $F_{UB}$ (unbalance inducing laundry) is deviated to any one of the first balancer 55*a* and the second balancer 55*b*.

In the case of FIG. 11, attenuation of unbalance of the drum 3 may require division of liquid injected from the nozzle 571 and supply of the liquid into the second balancer 55*b* and the third balancer 55*c* at a given ratio.

Even in this case, the controller (not shown) determines whether or not the drum 3 is rotated by the standby angle D after the unbalance inducing laundry $F_{UB}$ passes the nozzle 571, and supplies liquid to the first flow path 51 until the drum 3 reaches the supply angle S from a point in time when the unbalance inducing laundry $F_{UB}$ passes the nozzle 571.

Liquid supplied from the nozzle 571 while the drum 3 is rotated by the supply angle S (i.e., symmetrical angles on the basis of the first flow path divider 515) from a point in time when the drum 3 is rotated by the standby angle D may be supplied into the third space S3 and the second space S2 of the first flow path body 511, respectively.

As described above, when three balancers 55 are arranged on the circumference of the drum 3 and the standby angle D and the supply angle S are set to 60 degrees and 120 degrees respectively, the laundry treatment apparatus 100 of the present invention may supply a given amount of liquid satisfying the condition of FIG. 12 into a specific one of the balancers 55 regardless of a position of unbalance inducing force $F_{UB}$.

That is, in the case in which liquid is supplied to the first flow path body 511 while the drum 3 is rotated by an angle of 120 degrees after the drum 3 is rotated by an angle of 60 degrees from a point in time when unbalance inducing laundry $F_{UB}$ passes the nozzle 571, the amount of liquid supplied into the second space S2 and the amount of liquid supplied into the third space S3 may be controlled to generate force in a direction for removal of unbalance inducing force $F_{UB}$.

Although the control method as described above with reference to FIGS. 9 to 12 relates to the case in which a point in time to supply liquid and a liquid supply time of the nozzle 571 are controlled based on the rotation angle of the drum 3, the present invention may control unbalance of the drum 3 based on a standby time and a supply time which are set on the basis of a point in time when unbalance inducing laundry passes the nozzle 571.

That is, the controller (not shown) may determine whether or not a predetermined standby time D has passed after unbalance inducing laundry passes the nozzle 571, and may control the nozzle 571 to supply liquid to the first flow path 51 for a predetermined supply time S after the standby time D has passed.

In this case, the standby time D and the supply time S may vary based on the supply amount of liquid of the feeder 57 per unit time and the revolutions per minute of the drum 3. The standby time D may be set to a time required until the drum 3 is rotated by an angle of 60 degrees after unbalance inducing laundry passes the nozzle 571, and the supply time S may be set to a time required until the drum 3 is rotated by an angle of 120 degrees after the standby time D has passed.

Referring to FIG. 8(*b*), when the drum 3 is rotated at 150 RPMs, a time required for one revolution of the drum 3 is 0.4 sec. Thus, assuming that three balancers 55 are arranged on the circumference of the drum 3, the standby time D may be set to about 0.06 sec, and the supply time S may be set to about 0.13 sec.

FIG. 13 shows another embodiment of the laundry treatment apparatus 100 according to the present invention. In this embodiment, the flow path structure includes the first flow path 51 and a second flow path 52, and the feeder 57 includes a first supply port 57*a*, through which liquid is supplied into the first flow path 51, and a second supply port 57*b* through which liquid is supplied into the second flow path 52. The balancer 55 has a first inlet 5571, into which liquid is supplied from the first flow path 51, and a second inlet 5573 into which liquid is supplied from the second flow path 52.

Hereinafter, this additional embodiment will be described based on features different from the configuration of FIG. 1.

According to this embodiment, the receptacle body 551 of the balancer 55 is divided into a front space F facing the front surface 31 of the drum 3 and a rear space R facing the rear surface 33 of the drum 3 by the receptacle partition 553.

The front space F is divided into an upper space proximate to the rotation center of the drum 3 and a lower space proximate to the circumference of the drum 3 by the guide plate 559. The first inlet 5571 communicates with a space above the guide plate 559 (i.e. the aforementioned upper space) and the second inlet 5573 communicates with a space below the guide plate 559 (i.e. the aforementioned lower space).

The first flow path 51 includes the first flow path body 511, which extends from the front surface 31 of the drum 3 to the first supply port 57*a* and bends toward the guide 53 (i.e. toward the drum opening 311), and the first flow path dividers 515 to divide a space inside the first flow path body 511 into separate spaces equal in number to the balancers 55.

Each of the first flow path dividers 515 penetrates the front surface 31 of the drum 3 to thereby be inserted into the first inlet 5571. Accordingly, when liquid is supplied to the first flow path 51 through the first supply port 57*a* and the guide 53 (a first guide), the liquid may be supplied only into the rear space R of the balancer 55 under guidance of the guide plate 559.

On the other hand, the second flow path 52 includes a second flow path body 521, which extends from the front surface 31 of the drum 3 to the second supply port 57*b* and bends toward the first flow path body 511 (i.e., toward the drum opening 311), and second flow path dividers 525 to divide a space inside the second flow path body 521 into separate spaces equal in number to the balancers 55.

Although the second flow path body 521 has the same configuration as the first flow path body 511 (i.e., the second flow path body 521 being comprised of a second body mounted to the drum 3 and a second flange bending from the second body to the drum opening 311), the second flow path body 521 has a greater diameter than that of the first flow path body 511.

Each of the second flow path dividers 525 penetrates the front surface 31 of the drum 3 to thereby be inserted into the second inlet 5573. Accordingly, when liquid is supplied to the second flow path 52 through the second supply port 57*b*, the liquid may be supplied only into the front space F of the balancer 55.

In this case, a second guide (not shown) to prevent the liquid supplied from the second supply port 57*b* from moving in a direction opposite to a rotation direction of the drum 3 may be provided at the circumference of the first flow path body 511 facing the second flow path body 521.

The laundry treatment apparatus 100 according to the present embodiment may supply liquid into both the front space F and the rear space R of the balancer 55, thereby preventing generation of unbalance due to liquid introduced into the respective balancers 55, and preventing unbalance from being intensified due to liquid introduced into the balancers 55.

In addition, according to this embodiment of the present invention, through selective opening of the first supply port 57*a* and the second supply port 57*b*, it is possible to control unbalance induced when laundry accumulates only in a front region of the drum 3 or when laundry accumulates only in a rear region of the drum 3 (i.e., unbalance induced in a plane parallel to a longitudinal direction of the drum 3).

As is apparent from the above description, one effect of the present invention is providing a laundry treatment apparatus capable of actively eliminating dissymmetric rotation (unbalance) of a drum in which laundry is received.

Further, another effect of the present invention is providing a laundry treatment apparatus capable of eliminating unbalance of a drum by supplying liquid into a device provided to agitate laundry stored in the drum.

And yet another effect of the present invention is providing a laundry treatment apparatus capable of eliminating unbalance induced in a plane parallel to a diameter direction of a drum as well as unbalance induced in a plane parallel to a longitudinal direction of the drum.

It will be apparent to those skilled in the art that various modifications and variations can be made in embodiments of the present invention without departing from the spirit or scope of the invention.

What is claimed is:

1. A laundry treatment apparatus comprising:

a cabinet;

a laundry opening provided in a front surface of the cabinet to let laundry introduced into the cabinet;

a drum rotatably placed within the cabinet to store the laundry therein;

a drum opening configured to have a cylindrical shape protruded from the front surface of the drum to the laundry opening;

a balancing unit to attenuate unbalance of the drum caused by a nonuniform mass distribution of the laundry by locally increasing load of the drum via a supply of liquid to the balancing unit, the balancing unit including a plurality of balancers mounted to the drum to store liquid therein, the balancers being spaced apart from one another by the same angle around a rotation center of the drum, and each of the balancers comprising:

a receptacle mounted to an inner circumferential surface of the drum, the receptacle providing an inner space for storage of liquid;

an inlet formed at the receptacle, through which the liquid is introduced into the receptacle;

a guide plate to divide the inner space of the receptacle into an upper space facing the rotation center of the drum and a lower space facing the inner circumferential surface of the drum, the guide plate allowing the liquid introduced through the inlet to move from a center of the receptacle to an edge of the receptacle; and a flow path structure configured to guide liquid to each inlets of the balancers, the flow path structure comprising:

a flow path body mounted on the front surface of the drum and extending from the front surface to the drum toward the front surface of the cabinet to surround the drum opening;

a body flange extending from the flow path body toward the cylindrical surface of the drum opening such that a space is formed between the free end of the body flange and the drum opening;

one or more flow path dividers to divide the space defined by the flow path body and the body flange into separate spaces equal in number to the balancers, the flow path dividers allowing liquid introduced into a single space to be introduced only into one balancer; and a feeder to supply liquid to the space formed between the free end of the body flange and the cylindrical surface of the drum opening;

a guide to direct the liquid supplied from the feeder into the flow path body and to prevent the liquid supplied from the feeder from moving in a rotation direction of the drum or in a direction opposite to the rotation direction of the drum, wherein the guide includes:

a guide body extending from the front surface of the drum and located between the cylindrical surface of the drum opening and the body flange; a guide flange extending from the free end of the guide body toward the body flange so as to have a space between the free end of the guide flange and the free end of the body flange; and one or more guide dividers protruded from the guide body to divide the interior of the guide body into a plurality of spaces, the guide dividers preventing the liquid supplied from the feeder from moving in a rotation direction of the drum in the interior of the guide body, wherein the feeder is configured to supply water into the space between the free end of the guide flange and the free end of the body flange.

2. The apparatus of claim 1, wherein the receptacle includes:

receptacle partitions dividing the inner space of the receptacle into a plurality of spaces in a longitudinal direction of the drum; and communication holes formed at upper side of the each receptacle partition to communicate adjacent spaces divided by the receptacle partitions with each other.

3. The apparatus of claim 1, further comprising:

a sensing unit to sense a position of the nonuniform mass distribution laundry inducing unbalance of the drum; and a controller to control the feeder such that liquid is supplied into the flow path body while the drum is rotated by a predetermined supply angle after the drum is rotated by a predetermined standby angle from a point in time when the unbalance inducing laundry reaches the feeder.

4. The apparatus of claim 3, wherein the balancers are spaced apart from one another by an angle of 120 degrees along the circumference of the drum, and wherein the standby angle is set to 60 degrees, and the supply angle is set to 120 degrees.

5. The apparatus of claim 1, further comprising:

a sensing unit to sense a position of the nonuniform mass distribution of laundry inducing unbalance of the drum; and a controller to control the feeder such that, when a predetermined standby time has passed after the unbalance inducing laundry reaches the feeder, liquid is supplied into the first flow path body for a predetermined supply time from a termination point of the standby time.

6. The apparatus of claim 1, further comprising:

a drive unit including:

a stator, a rotor, to which a rotating shaft connected to the drum is coupled, a plurality of permanent magnets attached to the rotor to rotate the rotor under influence of a magnetic field of the stator; and a sensing unit to sense magnetic force of the permanent magnets and to determine a position of the nonuniform mass distribution of laundry inducing unbalance of the drum, wherein the number of the guide dividers is equal to the number of the permanent magnets, or is half the number of the permanent magnets.

7. The apparatus of claim 6, wherein the sensing unit detects a magnetic force of each permanent magnet passing the lowermost point of the rotation trace of the rotor, and wherein the feeder injects liquid to the guide passing the lowermost point of the rotation trace of the drum.

8. The apparatus of claim 1, wherein the balancer further includes:

an outlet to communicate the receptacle with the outside of the drum such that the liquid within the receptacle is discharged to the outside of the drum through the outlet.

* * * * *